US010160522B2

(12) United States Patent
Lisland et al.

(10) Patent No.: US 10,160,522 B2
(45) Date of Patent: Dec. 25, 2018

(54) TURRET

(71) Applicant: SCANA OFFSHORE AS, Vestby (NO)

(72) Inventors: Torkjell Lisland, Drøbak (NO); Lars Even Nilssen, Son (NO); Henrik Strand, Greåker (NO)

(73) Assignee: SCANA OFFSHORE AS, Vestby (NO)

( * ) Notice: Subject to any disclaimer, the term of this patent is extended or adjusted under 35 U.S.C. 154(b) by 0 days.

(21) Appl. No.: 14/910,852

(22) PCT Filed: Oct. 31, 2014

(86) PCT No.: PCT/EP2014/073440
§ 371 (c)(1),
(2) Date: Feb. 8, 2016

(87) PCT Pub. No.: WO2015/063262
PCT Pub. Date: May 7, 2015

(65) Prior Publication Data

US 2016/0368573 A1 Dec. 22, 2016

(30) Foreign Application Priority Data

Nov. 1, 2013 (NO) ..... 20131450

(51) Int. Cl.
*B63B 21/50* (2006.01)
*E21B 19/00* (2006.01)
*B63B 22/02* (2006.01)

(52) U.S. Cl.
CPC ..... *B63B 21/507* (2013.01); *E21B 19/004* (2013.01); *B63B 2022/028* (2013.01)

(58) Field of Classification Search
CPC ..... B63B 21/507; B63B 2022/028; E21B 19/004
See application file for complete search history.

(56) References Cited

U.S. PATENT DOCUMENTS 4,955,310 A 9/1990 Pollack
5,515,804 A 5/1996 Pollack
(Continued)

FOREIGN PATENT DOCUMENTS

EP 1433699 A1 6/2004
NO 970071 A 7/1998
(Continued)

OTHER PUBLICATIONS

Schmitter, Thierry, "International Search Report," prepared for PCT/EP2014/073440, dated Feb. 9, 2015, four pages.

*Primary Examiner* — Ajay Vasudeva
(74) *Attorney, Agent, or Firm* — Winstead PC

(57) ABSTRACT

A turret mooring and riser hang-off arrangement, for transferring petroleum products from an off-shore or subsea facility to a vessel, including a turret arranged in a cavity of the vessel. The turret is held firmly in axial and radial directions within the cavity, but is rotatable relative to the vessel. The turret is adapted to be moored to the seabed. A riser assembly extends through a bore in the turret to an upper surface of the vessel. The bore of the turret is a monobore and the riser assembly is rotationally coupled to the turret but is free to move axially relative to the turret. The riser assembly is axially supported by the vessel.

9 Claims, 12 Drawing Sheets

(56) References Cited

U.S. PATENT DOCUMENTS

| | | | | |
|---|---|---|---|---|
| 6,698,372 | B2 * | 3/2004 | Hobdy | B63B 21/507 114/230.12 |
| 2003/0121465 | A1 | 7/2003 | Boatman et al. | |
| 2005/0005832 | A1 * | 1/2005 | Uittenbogaard | B63B 21/507 114/230.12 |

FOREIGN PATENT DOCUMENTS

| | | | |
|---|---|---|---|
| WO | WO-9830436 | A1 | 7/1998 |
| WO | WO-9917983 | A1 | 4/1999 |
| WO | WO-0151347 | A1 | 7/2001 |
| WO | WO-0232753 | A1 | 4/2002 |
| WO | WO-2009141351 | A2 | 11/2009 |

* cited by examiner

TURRET

FIELD OF THE INVENTION

The present invention in general, relates to turrets for transferring petroleum products from an off shore, including subsea, facility, to a vessel/ship.

Particularly, the present invention relates to a turret which is suitably connected with the riser pipe assembly/tubes and also with the vessel, such that the anchoring forces are largely absorbed up by the turret and the turret is able to transfer radial forces acting on it on to the vessel and rotational momentum on to the riser pipe assembly/riser tubes. Thereby the vessel is allowed to rotate relative to the turret and the riser assembly.

More particularly, the present invention relates to a turret as claimed herein.

TECHNICAL BACKGROUND OF THE INVENTION

It is common knowledge that petroleum products extracted from a well is stored on a floating storage facility or a sub sea tank. It is also known that it may be a Floating Production, Storage and Off loading vessel (commonly known as FPSO) or an Offshore Storage Unit (FSU) which are employed to temporarily store oil received from the well. These will in the following commonly be called storage vessel or simply vessel. Subsequently, it is transferred to an oil-tanker ship/vessel to bring it to the shore. Turrets are known to be employed for such transfer.

Some types of turrets are deployed at sea and the storage vessel has to position itself above the turret, and the turret is brought into a cavity beneath the vessel. When the turret is positioned within the cavity it is securely fixed to the vessel.

The turret that is used in connection with the present invention is installed in the vessel at the wharf, while the vessel is still in a dry dock. After the vessel has reached the offshore site where it is planned to be situated for receiving the hydrocarbons, the turret is connected to conduits from the oil or gas producing facility and also with mooring chains or wires to attach the turret to the seabed. Via the conduits petroleum products are transferred into the vessel. For that purpose, it is known that a riser pipe assembly and/or riser tubes, have to pass through the turret for ensuring transfer of the petroleum products to a receipt facility, which includes a swivel, located on the deck of the vessel.

To undertake the transfer operation without the risk of the vessel moving to an extent that could jeopardize the integrity of the conduits, the turret has to be properly moored to the sea bed, which naturally, ensures mooring of the vessel as well. Once the turret is moored to the sea, mooring forces act on the entire arrangement.

For safe transfer or the petroleum products, it is of utmost importance that the turret, the riser pipe assembly/riser tubes and the vessel should move vertically together. Further, it is also essential that the vessel, the riser pipe assembly/riser tubes and the turret should move horizontally together during the transfer, although this movement should be kept to a minimum. The vessel is allowed to rotate relative to the turret so that the vessel can be placed with its bow against the wind and/or waves.

The requirement stated in the preceding paragraph is essential to obtain optimal alignment and equilibrium in the whole arrangement. For that purpose, it is of utmost importance that the mooring forces are largely absorbed up by the turret and that other forces acting on the entire arrangement, should be suitably distributed and absorbed, so as to obtain optimal force distribution.

Patent publication WO 0151347 A1 discloses a rotating tower system for transferring hydrocarbons to a ship. It discloses a lower rotating body and an upper rotating body connected by an intermediate member. These two rotating bodies are independently mounted in relation to the ship/vessel. The lower and upper rotating bodies are each connected to the central portion of the intermediate member by respective articulated bearings for allowing angular deviations and for absorbing possible axial/radial forces acting on the arrangement during transfer.

WO 9917983 shows another turret arrangement having an inner tubular and an outer annular. All the risers are arranged in the annular part of the turret. It is not disclosed how the risers are hung off.

WO 2009141351 shows yet another turret arrangement. The risers are connected to some sort of manifold in the turret. There is no monobore in the turret.

EP 1433699 shows yet another turret arrangement. Here the turret is supported by an upper bearing above the deck of the ship. The riser package is supported vertically by the turret.

NO 19970071 also shows a turret arrangement where the risers are supported vertically by the turret.

The above prior art and also other prior art known in the field does not specifically teach how a turret can have features for connecting with the riser pipe assembly/riser tubes and with the vessel, so that the anchoring forces are largely absorbed by the turret, and so that the vertical hang-off forces from the riser package are absorbed by the ship independently of the turret.

In existing turret and riser systems, the turret and riser package are tailor-suited to one another. This means that when the production characteristics of the field changes, e.g., from a mainly oil producing field to a predominantly gas producing field, or if the same vessel is to receive hydrocarbons from a nearby field, the whole turret and riser arrangement may have to be changed in order to adapt to the new needs.

The present invention meets the needs mentioned in the preceding paragraph and other associated needs by providing a turret which is equipped with features for connection with the riser pipe assembly/riser tubes and for connection with the vessel so that optimal force distribution is achieved in the arrangement during petroleum transfer.

OBJECTS OF THE INVENTION

It is the prime object of the present invention to provide a turret equipped with connections such that the anchoring forces acting on the entire arrangement during petroleum transfer are largely absorbed by the turret.

It is another object of the present invention to provide a turret which, during petroleum transfer to a vessel, can transfer rotational momentum to the riser pipe assembly and radial force acting on the turret to the vessel.

It is also an object of the invention to arrive at a system by which the vertical forces acting on the riser package is absorbed by the vessel as such and not by the turret.

It is another object of the present invention to provide a turret through which the riser pipe assembly can be installed after installation of the turret.

It is a further object of the present invention to provide a turret which is compact and has a relatively small height.

It is also an object of the invention to provide a turret with an increased expected life time, and especially through a turret that is flexible in the fact that it can be reconfigured with different types of riser packages.

It is also an object of the invention that the above reconfiguration of the turret can be done without bringing the vessel into dry-dock, preferably the reconfiguration should be possible while the vessel is at the offshore operational site. Thereby the system can easily be adapted to the present needs.

SUMMARY OF THE INVENTION

The above objects are achieved by a turret mooring and riser hang-off arrangement, for transferring petroleum products from an off-shore or subsea facility to a vessel, comprising a turret arranged in a cavity of the vessel, said turret being held firmly in axial and radial directions within the cavity, but being rotatable relative to the vessel, said turret being adapted to be moored to the seabed; and a riser assembly extending through a bore in said turret to an upper surface of the vessel, wherein said bore of said turret is a monobore, said riser assembly being rotationally coupled to said turret but being free to move axially relative to said turret, said riser assembly being axially supported by the vessel.

Preferably, the turret has a generally circular cylindrical cross-section and is provided with at least one axial bearing at its upper end as well as at least one radial bearing some distance below said at least one axial bearing. Thereby the turret is securely held in the cavity in the axial and radial directions of the turret.

Preferably, the turret has a height that is substantially shorter than the height between the bottom of the vessel and the upper surface of the vessel. This reduces the distance between the bearings of the turret and hence the risk for misalignment between the bearings.

In a preferred embodiment, the turret bore has at least one radial bearing forming an interface with said riser assembly to transfer radial forces between said riser assembly and said turret. This ensures that the riser assembly moves along with the turret in the radial, i.e. the horizontal direction.

In a preferred embodiment, one of said turret bore or said riser assembly is provided with at least one projection, said projection interacting with a corresponding notch or cut-out of the other one of said riser assembly or said turret, for transferring rotational momentum between the turret and the riser assembly. Thereby is ensured that the riser package rotates along with the turret relative to the vessel.

Preferably, said projection or said notch or cut-out is formed on a plate like structure extending radially outward from said riser assembly. This ensures that the risers have a certain distance to the turret and facilitates the installation and removal of the riser package when necessary.

Preferably, said radial bearing interacts with a plate like structure extending radially outward from said riser assembly, said plate like structure having a notch or cut-out that enables the plate like structure to pass said protrusion during installation of said riser assembly. This facilitates the installation and removal of the riser package.

Preferably, the axial forces acting on the riser assembly are taken up by at least one axial bearing attached to said vessel, by which axial bearing said riser assembly is free to swivel relative to the vessel. This ensures that the riser package is hanged-off in the vessel so that all vertical forces acting on the risers are transferred to the vessel and not to the turret. Moreover, the vessel and the risers are free to rotate relative to one another, ensuring that the risers do not get twisted or are exposed to torsion.

In one embodiment cavity is arranged within a moonpool through the hull of the vessel in the forward part of the vessel. This protects the turret and the risers from weather and impact, while ensuring that the vessel is capable of turning with the current around the turret.

In another embodiment said cavity is arranged in a structure attached to the bow of the vessel, and said upper surface of the vessel is an upper surface of a structure attached to the upper part of the bow of the vessel. Thereby the turning axis of the vessel is a far forward as possible, and the vessel will quickly turn with the current.

All through the specification including the claims, the words "vessel", "ship", "oil-tanker", "anchoring", "mooring", "turret", "chain", "swiveling", "chain stopper unit", "rotating", "riser pipe assembly/riser tubes" are to be interpreted in the broadest sense of the respective terms and includes all similar items/devices/methods in the field known by other terms, as may be clear to persons skilled in the art.

Restriction/limitation, if any, referred to in the specification, is solely by way of example and understanding the present invention. Further, the terms "chain stopper unit" and "mooring system/unit" have been mentioned to refer to the same features.

BRIEF DESCRIPTION OF THE DRAWINGS

Having described the main features of the invention above, a more detailed and non-limiting description of an exemplary embodiment, with reference to the drawings is provided below.

DETAILED DESCRIPTION OF THE INVENTION

Figure 1:
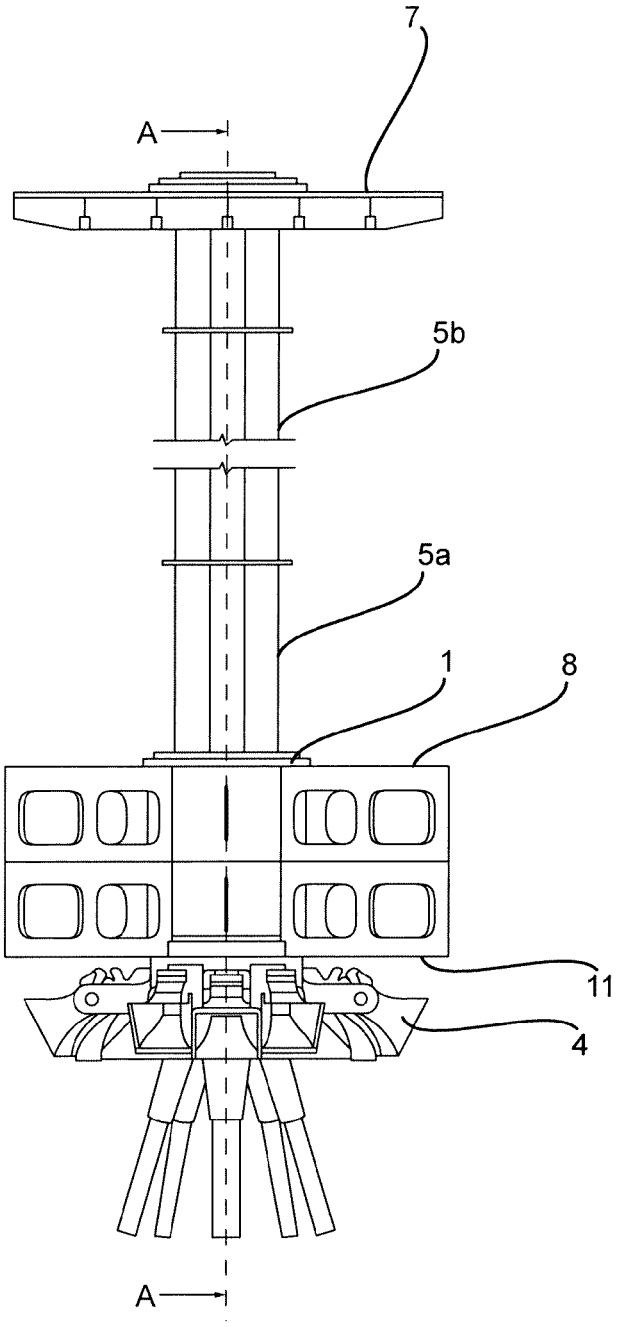
FIG. 1 is a front view of the turret in connectivity with the riser pipe assembly and the vessel according to the present invention.

The following describes a preferred embodiment of the present invention which is purely exemplary for the sake of understanding the invention and non-limiting.

In all the figures, like reference numerals represent like features. Further, when in the following it is referred to "top", "bottom", "upward", "downward", "above" or "below", "right hand side" or "left hand side" and similar terms, this is strictly referring to an orientation with reference to the sea bed, where the sea bed is considered to be horizontal and at the bottom, and where left and right refers to the position in the drawings.

It should also be understood that the orientation of the various components may be otherwise than shown in the drawings, without deviating from the principle of the invention. Also in the figures components have been shown only on one side of the turret for the sake of simplicity. These components can be present on both sides of the turret and this is within the scope of the present invention. Furthermore, the disposition of off-shore units like off-shore storing facilities, vessels/ships/oil tankers and related units are not shown in detail, as those are not consequential to the present invention and should be understood by persons skilled in the art.

Figure 7:
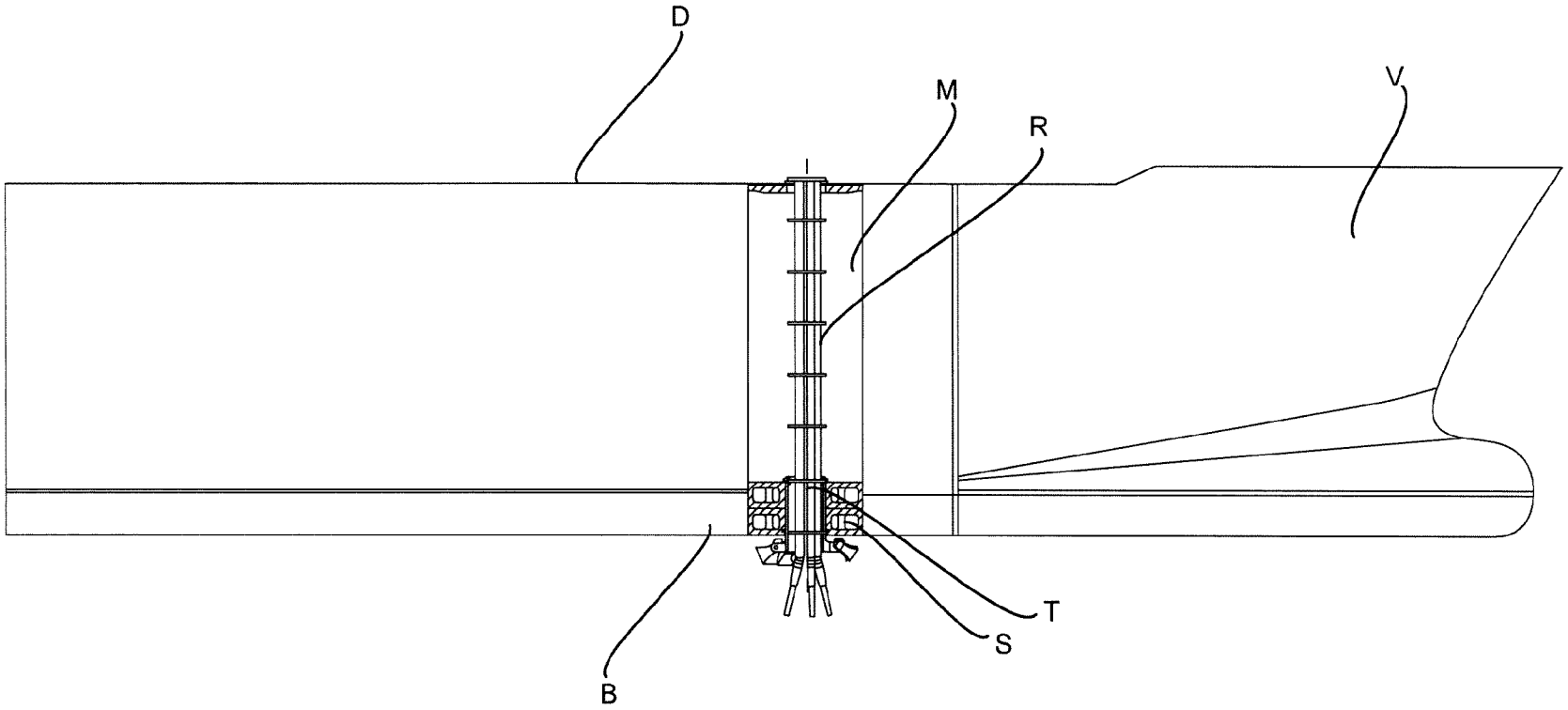
FIG. 7 is a view of the forward part of a vessel having a turret system according tot eh invention.

FIG. 7 shows the forward part of a vessel V having a moonpool M extending from the deck D of the vessel to the bottom B of the vessel. In the moonpool is arranged a structure S, which provides a receptacle for a turret T. The structure S forms a part of the hull of the vessel. A riser package R extends through the turret T up to the deck D of the vessel V.

Figure 2:
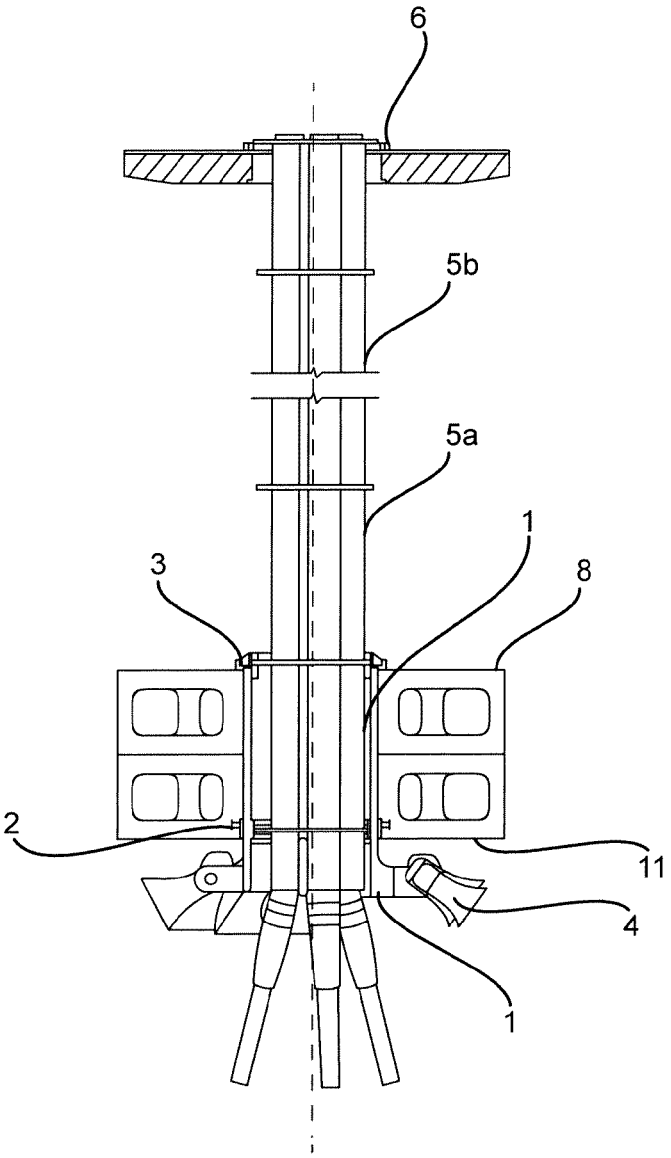
FIG. 2 is a sectional view along the line A-A in FIG. 1.
Figure 3:
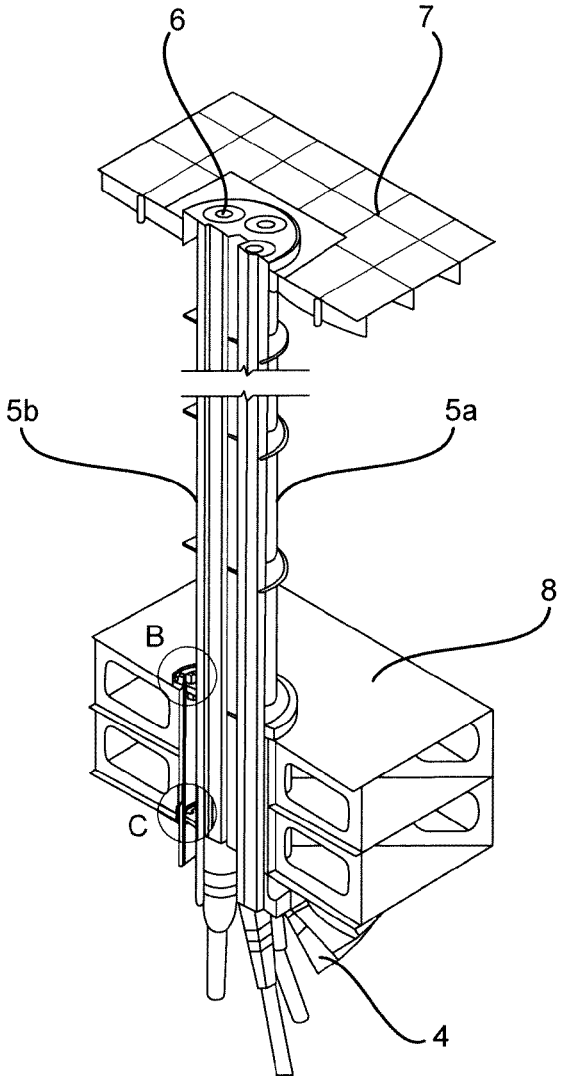
FIG. 3 is a perspective view of the turret, riser pipe assembly, as well as portions of the vessel.

FIG. 1 is a front view of the turret arrangement, FIG. 2 is a section along the line A-A in FIG. 1 and FIG. 3 is a perspective view showing the turret 1 (T in FIG. 7), the riser pipe assembly 5*a* (R in FIG. 7) and the individual riser tubes 5*b*. These three figures also partially show the deck 7 (D in FIG. 7), the hull structure 8 (S in FIG. 7) and the bottom portion 11 (B in FIG. 7) of the vessel (V in FIG. 7), but the vessel in totality is not shown in these figures for the sake of simplicity.

To understand the structure as explained immediately hereinafter, all the three FIGS. 1 to 3 should be referred to and construed together.

Referring to FIGS. 1 to 3, the turret 1 has a cylindrical body which allows riser pipe assemblies and riser tubes to pass through. It should be understood that depending upon requirement only riser pipe assembly or only riser tubes such as say umbilicals may pass through the turret. In the embodiment, both riser assembly 5*a* and riser tubes 5*b* pass through the turret 1, as it would be particularly clear from FIG. 3.

In the embodiment shown, the turret has a compact structure and has height extending between the bottom 11 of the vessel and into its hull 8.

The riser pipe assembly 5*a* and riser tubes 5*b* extend from the bottom 11 to the deck 7 of the vessel.

Referring to FIG. 2 in particular, near the top portion of the turret 1, within the hull 8, the turret has an axial bearing 3. The turret 1 can rotate freely with the help of this bearing 3 and absorbs axial force acting on it. The turret 1 also has a radial bearing 2 near the bottom 11 of the vessel which is located at the side of the turret 1 that is adjacent to the vessel. The radial forces acting on the turret 1 are transferred to the body of the vessel by this bearing 2. Elaborate functioning and consequential importance of these bearings will been explained below.

Referring to FIG. 3 in particular, the axial bearing 6 on the deck 7 of the vessel is also seen, which absorbs the axial forces acting on the riser pipe assembly 5*a* and the riser tubes 5*b*. The riser pipe assembly 5*a* and riser tubes 5*b* can rotate relative to the deck 7 by means of this bearing 6. The axial bearing can also be situated at another appropriate level, such as at a lower deck or in a structure placed on the upper deck.

The FIGS. 1 to 3 also show the chain stopper unit 4 for attachment of a mooring chain (not shown) for mooring the turret 1 and thus the vessel.

Figure 4:
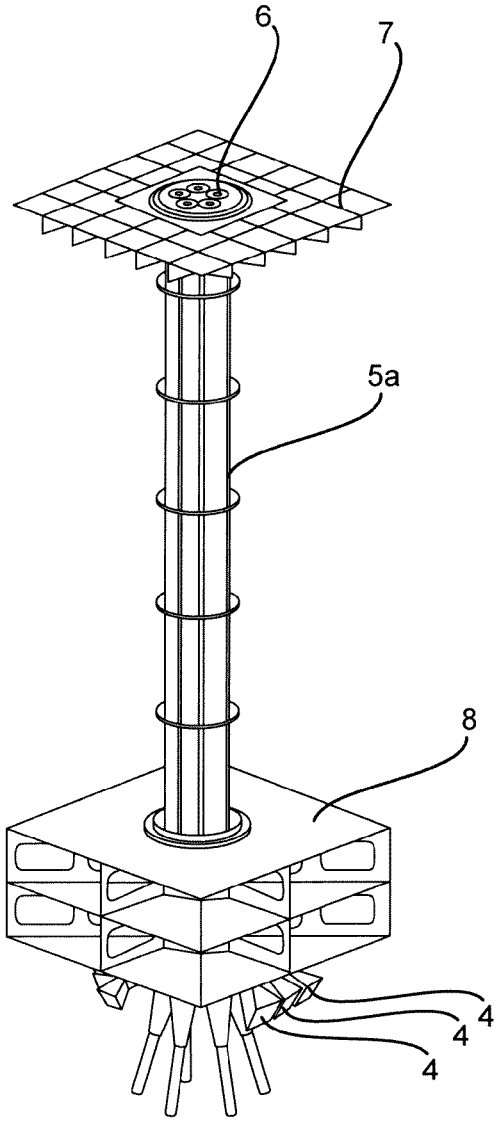
FIG. 4 is another perspective view of the entire arrangement from another angle.

FIG. 4 is a perspective view of the complete arrangement from another angle. None of the FIGS. 1 to 4, however, show the mooring chain for the sake of simplicity. It is known that such chain passes through the turret housing and through the chain stopper units 4, for mooring the turret 1.

Figure 5A:
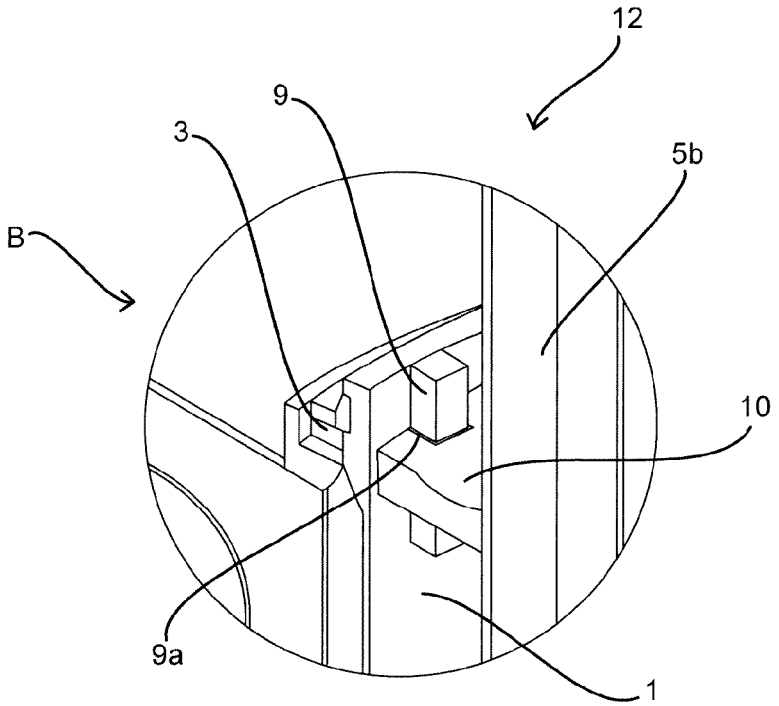
FIG. 5*a* is an enlarged view of the portion marked B in FIG. 3

FIG. 5*a* is an enlarged portion of the region marked B in FIG. 3. From FIG. 5*a* it would be clear that the turret 1 has a spline like protrusion 9 at its sides adjacent to the riser pipe assembly 5*a* and riser tubes 5*b*, close to the hull 8 of the vessel This spline like protrusion 9 will be present on either side of the turret 1, or there may be any number of splines 9 distributed around the inner circumference of the turret. The spline like protrusion 9 engages with a groove 9*a* (similar features shown in FIG. 5*b*) located on a plate like body 10 attached to the side of the riser pipe assembly/riser tubes 5*a*, 5*b* facing the turret 1.

The features 9, 9*a*, 10 described in the preceding paragraph constitutes a rotational transfer means 12 to facilitate transfer of rotational momentum from the turret 1 to the riser pipe assembly/riser tube 5*a*, 5*b* as explained below.

Figure 5B:
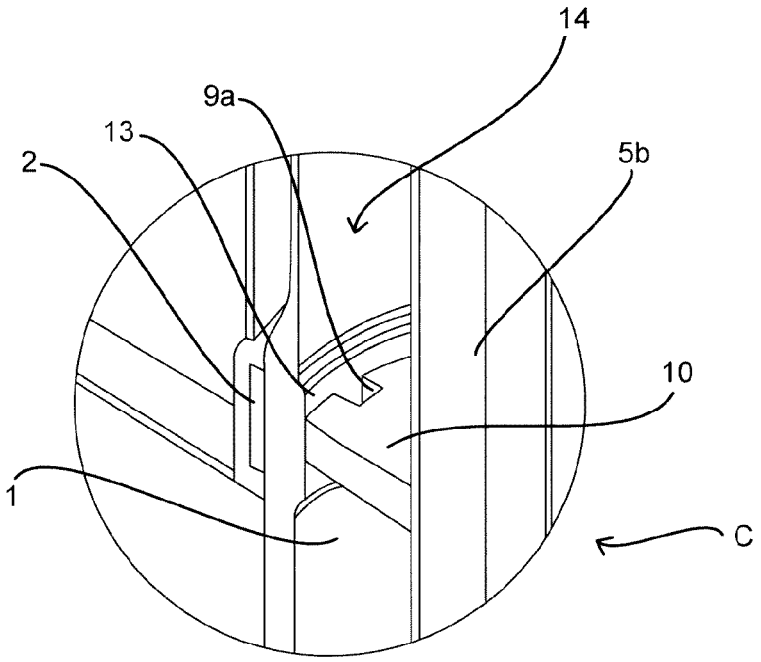
FIG. 5*b* is an enlarged view of the portion marked C in FIG. 3.

FIG. 5*b* is an enlarged portion of the region marked C. It shows that a plate like body or ring 10 also exists between the turret 1 and the riser pipe assembly/riser tubes 5*a*, 5*b* close to the bottom 11 of the vessel. The plate like body 10 also has a groove 9*a*, which merely serves to get the plate 10 past the splines 9 during installation of the riser package. This groove 9*a* and plate like body 10 may be identical to the ones atop these in the region marked B in FIG. 3 and as shown in FIG. 5*a*. The plate like body 10 just like the identical feature located atop it in the region marked B in FIG. 3, is attached to the side of the riser package 5*a* facing the turret 1. The plate like body 10 bears against a reinforced region 13 on the inside of the turret 1, The features 10 and 13 constitutes a radial bearing 14 for transferring axial forces between the turret and the riser package 5*a*.

The FIG. 5*b* also elaborately shows the radial bearing 2, as discussed hereinbefore with reference to FIG. 2.

Instead of the radial bearing 14 and the rotational transfer means 12 being situated one at the lower end of the turret 1 and one at the upper end of the turret 1, both can be situated next to one another anywhere along the height of the turret. It is also possible to combine both functions into one set of features. This can be done by adding a reinforced region between the turret wall and the spline 9 in FIG. 5*a* and/or by attaching, e.g., by welding, a spline onto the reinforced region 13 in FIG. 5*b*.

Figure 8:
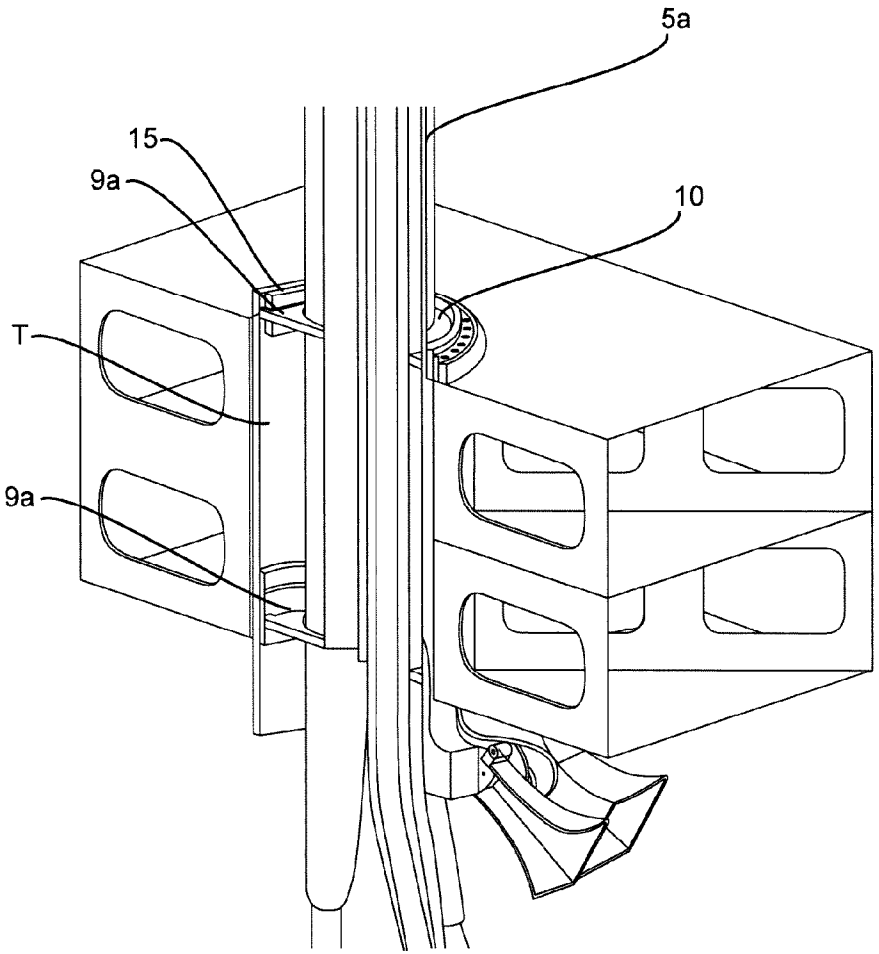
FIG. 8 is perspective sectional view similar to FIG. 3 of the turret of the invention with an alternative embodiment of the means for transferring the rotational and axial forces between the riser package and the turret.
Figure 9:
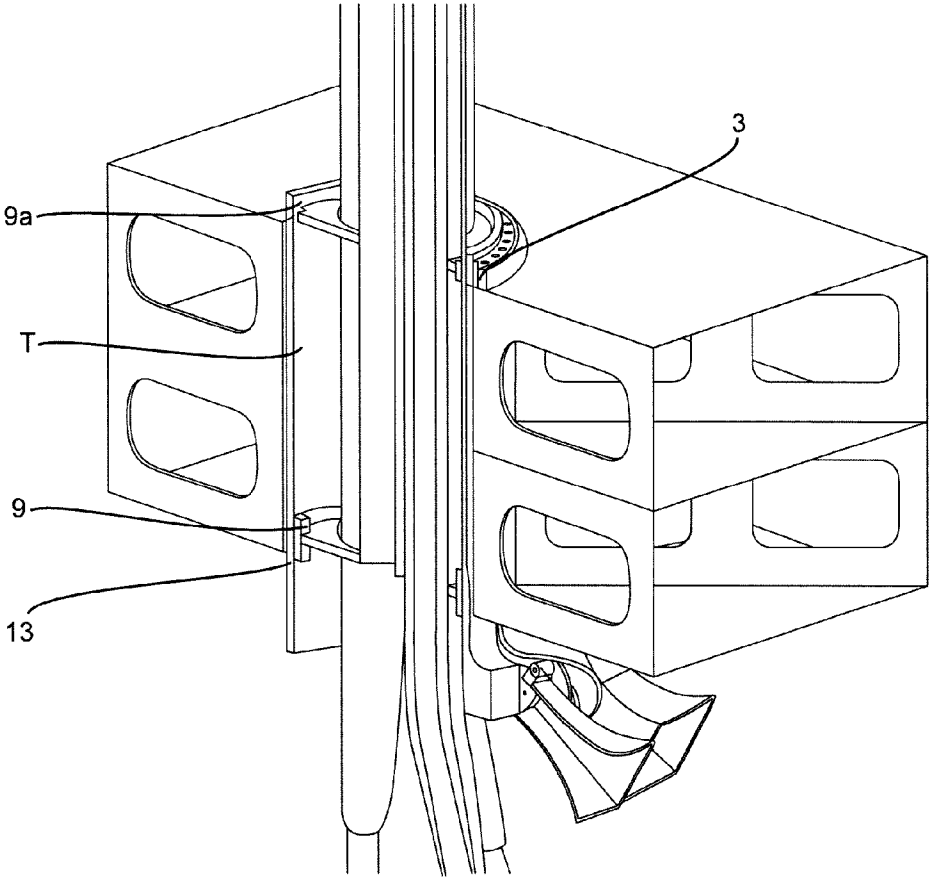
FIG. 9 is a view similar to FIG. 8 with yet another alternative of the means for transferring the rotational and axial forces between the riser package and the turret.

Further alternatives for transfer of rotation and axial forces between the turret and the riser package are shown in FIGS. 8 and 9. In FIG. 8 the splines 9 has been replaced by a broader semi-circular section 15. These may extend along a majority of the circumference of the turret 1. The plates 10 of the riser assembly are provided with corresponding semi-circular cut-outs 9*a*. This allows for transfer of greater rotational torque.

In FIG. 9 splines 9 have been attached to the reinforced region 13, thereby combining the rotational torque transfer function and the axial bearing into one.

How the features elaborated in FIGS. 5*a*, 5*b*, 8 and 9 contribute to achieve proper force distribution during petroleum transfer will be been explained below.

As explained before the turret is installed into the vessel before the vessel leaves the harbor and is consequently an integrated part of the vessel. The riser package may also be installed before the vessel leaves the harbor, but may conveniently be installed offshore after the vessel has been moored through the turret. Consequently, the installation process of the riser package will now be explained.

Figure 6A:
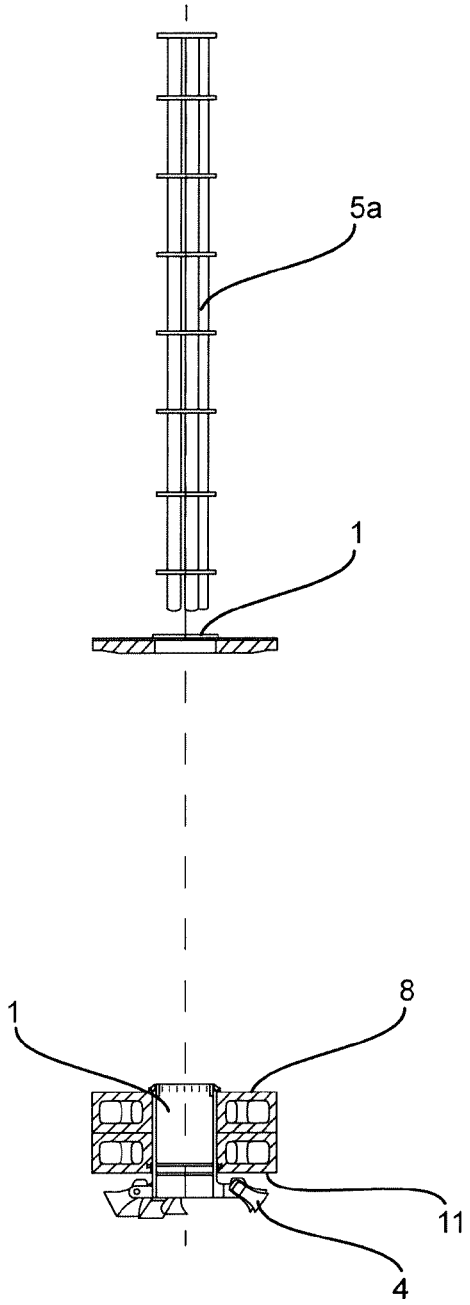
FIGS. 6*a*, 6*b* and 6*c* are views of various stages of installation of the riser pipe assembly/riser tube within the turret, in that order.
Figure 6B:
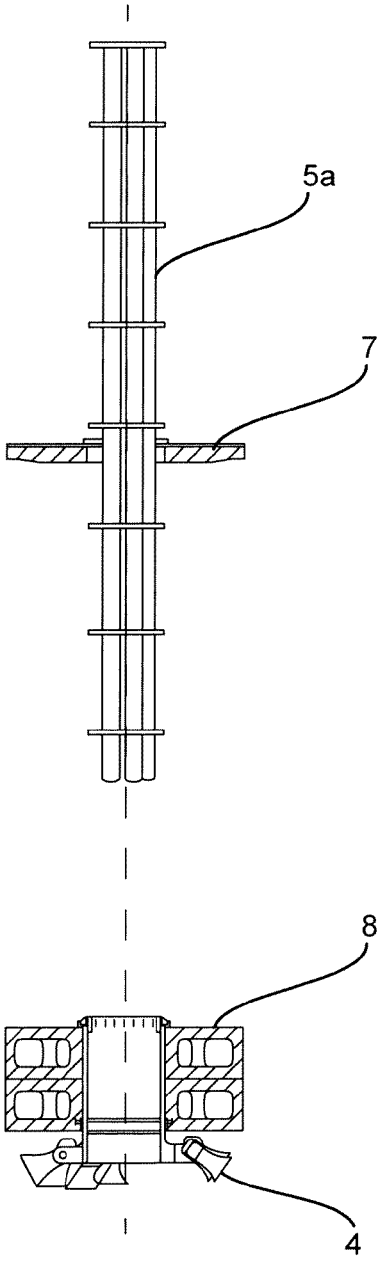
Figure 6C:
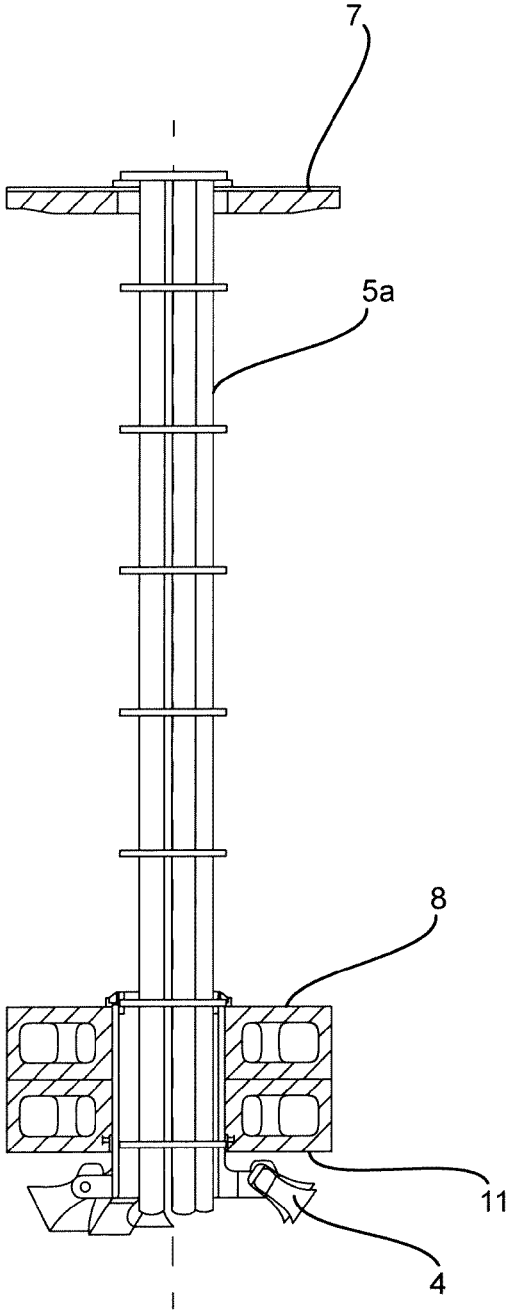

FIGS. 6*a*, 6*b* and 6*c* are views of different stages of installation of the riser pipe assembly 5*a* with the riser tubes 5*b* within the turret 1.

Further FIGS. 6*a*, 6*b* and 6*c* emphasize that the riser pipe assembly 5*a* can be installed after installation of the turret 1 when it is moored to the seabed and has achieved reasonable equilibrium with the vessel.

All the above figures are again referred to while explaining the functioning as herein below.

Referring to FIGS. 1 to 4, these figures indicate the entire arrangement in operation, with the turret 1 moored to the seabed (not shown).

Now, at this position, it should be understood that the mooring forces act on the entire arrangement. Further, due to constant wave motion the entire arrangement moves vertically as well as horizontally. Having regard to this aspect, it should be also understood that the turret 1 and the riser pipe assembly/riser tubes 5*a*, 5*b* also have rotational motion.

To ensure optimal equilibrium and alignment, it is essential that the turret 1, the riser assembly 5*a* and the vessel should move together both vertically and horizontally. However, the turret should not take up the weight of and other vertical forces acting on the riser assembly.

Also, to ensure that the vessel, turret and riser package move together vertically and horizontally, but that the vessel can rotate relative to the turret and the riser package, it is essential that the mooring/anchoring forces are largely absorbed by the turret 1 and the other forces are also judiciously distributed and absorbed. This also ensures that the riser assembly 5*a* can be installed after installation of the turret 1, since the turret 1 and the vessel may achieve equilibrium prior to installation of the riser assembly 5*a*.

How, the above aspects are taken care of are now explained. The axial bearing 6 on the main deck 7 of the vessel absorbs the axial forces acting on the riser assembly 5*a*. The riser pipe assembly 5*a* can freely rotate by virtue of this axial bearing 6, relative to the deck 7.

The axial bearing 3 on the top portion of the turret 1 close to the hull 8, absorbs the axial force acting on the turret 1. By means of this axial bearing 3, the turret 1 can rotate relative to the vessel. This ensures that the vessel, the riser assembly/riser pipe 5*a*, 5*b* always move together vertically when the turret and thus the vessel are moored to the sea bed by means of a mooring chain (not shown) and chain stopper 4.

FIGS. 5*a* and 5*b* are views of an embodiment of two aspects of the invention. The below explanation is also valid for the embodiments of FIGS. 8 and 9, with slights modifications, that will be obvious to a person of skill inn the art.

FIG. 5*a*, as stated before, is the enlarged portion of the region marked B in FIG. 3. This portion is near the top of the turret 1. It can be seen from FIG. 5*a* that the turret 1 has a spline-like protrusion 9 which engages with a groove 9*a* (identical structure shown in FIG. 5*b* and can be referred to for clarity) located on a plate like structure 10. The plate like structure is located between the turret 1 and the riser pipe assembly 5*a*. This structure 10 is formed on side of the riser pipe assembly 5*a* facing the turret 1.

Thus, the spline protrusion 9 is on the inside face of the turret 1 which is adjacent to the riser pipe assembly/riser tubes 5*a*, 5*b*. The outside face or the other side of the turret 1 is adjacent to a moonpool through the vessel.

This spline-like protrusion 9 feature, as explained above with reference to FIG. 5*a*, ensures that the rotational momentum on the turret 1 is transferred on to the riser pipe assembly 5*a*. These ensure that the turret 1 and the riser pipe assembly 5*a* rotate around a substantially vertical axis in unison relative to the vessel.

Now, during operation, the riser assembly 5*a*, the turret 1 and the vessel undergo axial movement as explained above. The plate like structure 10 is on the riser assembly/riser tube 5*a*, 5*b* face, adjacent to the turret 1. The spline 9 is in positive engagement with the groove 9*a*, as shown in FIG. 5*a*, but at the same time during axial movement of the riser pipe assembly/riser tubes 5*a*, 5*b*, the structure 10 on the riser assembly 5*a* can move up and down along the spline 9, due to this groove facility 9*a*, and hence no axial forces from the riser package are taken up by the turret 1. This also ensures that rotational momentum on the turret 1 is transferred on to the riser pipe assembly 5*a*.

The region marked C in FIG. 3 is another advantageous aspect of the present invention. The enlarged portion of C is shown in FIG. 5*b*. The reinforced section comprises a plate like structure 10, similar to the one above it in region B, which is located between the turret 1 and the riser pipe assembly 5*a*. But the plate like structure 10 is actually formed on the side of the riser pipe assembly 5*a* very much like the one located above.

This reinforcement section ensures transfer of radial forces acting on the riser pipe assembly 5*a* on to the turret 1, so that it can absorb such forces, and vice versa.

The groove 9*a* in the region C has no role to play as such. It only ensures that during axial installation of the riser pipe/tube body the plate 10 can pass through the spline like protrusion 9 on the turret 1, located immediately above, in the region B. Precisely, even if the groove 9*a* was not there in region C, the reinforcement section 10 could have transferred radial forces on to the turret 1.

FIG. 5*b* also shows the radial bearing 2 in detail. This can also be seen in FIG. 2. This radial bearing 2, as can be seen from FIGS. 2 and 5*b*, is located on the outer side of the turret 1 which is adjacent to the vessel body and is near the bottom portion 11 of the vessel. This radial bearing 2 ensures that all radial forces acting on the turret 1 are transferred to and absorbed by the vessel. These radial forces naturally include the forces transferred to the turret 1 by the riser pipe assembly 5*a* by the reinforcement portion 10 in region C of FIG. 3.

The radial bearing 2 thus ensures that the turret 1, the vessel and the riser pipe assembly 5*a* always move together horizontally.

FIGS. 6*a*, 6*b* and 6*c* are views representing different stages of installation of the riser pipe assembly 5*a*. It can be seen that prior to installation of the riser pipes 5*a* the turret 1 has been installed and moored by a method know per se, and has achieved equilibrium with the vessel. Further, in this embodiment shown in FIGS. 6*a*, 6*b*, 6*c* the turret 1 extends from the deck 7 of the vessel to its bottom region 11.

At the first stage as shown in FIG. 6*a*, the riser pipe package 5*a* is slowly lowered down to the opening in the vessel deck 7. In FIG. 6*b* the pipe package 5*a* has been lowered through the opening in the vessel deck 7 and moves down towards the turret 1. FIG. 6*c* is the next stage when the riser pipes 5*a* have been brought further down and placed inside the turret 1 in position. Thereafter the connections are all established to start transfer of petroleum which is the stage shown in FIG. 4.

Figure 10:
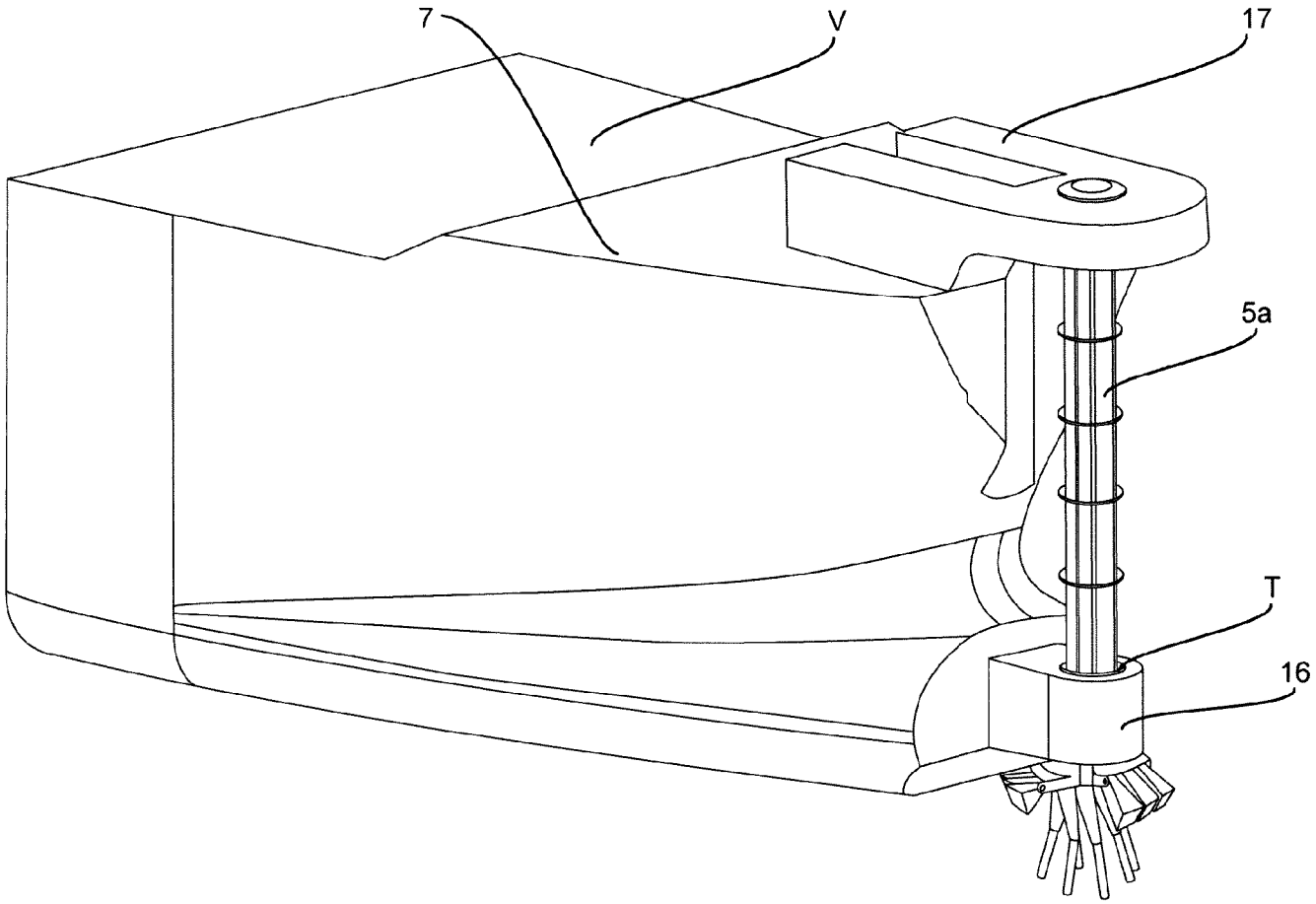
FIG. 10 illustrates an alternative placement of the turret system in the bow of the vessel.

FIG. 10 shows the turret system and associated riser package installed in the bow of the vessel. Here the turret is placed in a structure 16 that extends forward of the bow near the bottom of the vessel. On the deck 7 of the vessel another structure 17 is attached. This structure also extends forward to the bow. In both structures a through going opening has been formed. The openings are aligned with one another, so that the riser package 5*s* can extend between them.

The advantage of placing the system in the bow of the vessel is that the vessel will have a greater ability to turn with the prevailing current and wind.

From the description hereinbefore it would be clear to persons skilled in the art that all objectives of the invention have been achieved.

The present invention has been described with reference to some preferred embodiments and some drawings for the sake of understanding only and it should be clear to persons skilled in the art that the present invention includes all legitimate modifications within the ambit of what has been described hereinbefore and claimed in the appended claims.

The invention claimed is:

1. A turret mooring and riser hang-off arrangement, for transfer of petroleum products from an off-shore or subsea facility to a vessel, the turret mooring and riser hang-off arrangement comprising:

a turret arranged in a cavity of the vessel, the turret being suspended in an axial direction by a first axial bearing that is arranged within a hull of the vessel, and also being held in radial directions within the cavity, but being rotatable relative to the vessel, the turret being adapted to be moored to the seabed;

a riser assembly extending through a bore in the turret to an upper surface of the vessel, wherein the bore of the turret is a monobore;

the riser assembly being rotationally coupled to transfer rotational torque to the turret but being free to move axially relative to the turret;

the riser assembly being axially supported by the vessel during the transfer of the petroleum products by a second axial bearing attached to the upper surface of the vessel; and wherein the second axial bearing allows the riser assembly to rotate relative to the upper surface of the vessel during the transfer of the petroleum products.

2. The turret mooring and riser hang-off arrangement according to claim 1, wherein the turret has a generally circular cylindrical cross-section and is provided with the first axial bearing at an upper end thereof and at least one radial bearing some distance below the first axial bearing.

3. The turret mooring and riser hang-off arrangement according to claim 1, wherein the turret has a height that is substantially shorter than the height between the bottom of the vessel and the upper surface of the vessel.

4. The turret mooring and riser hang-off arrangement according to claim 1, wherein the bore has at least one radial bearing forming an interface with the riser assembly to transfer radial forces between the riser assembly and the turret.

5. The turret mooring and riser hang-off arrangement according to claim 4, wherein the radial bearing interacts with a plate extending radially outward from the riser assembly, the plate having a notch or cut-out that enables the plate to pass a projection provided in bore during installation of the riser assembly.

6. The turret mooring and riser hang-off arrangement according to claim 1, wherein one of bore and the riser assembly is provided with at least one projection, the projection interacting with a corresponding notch or cut-out of the other one of the riser assembly or the turret, for transferring the rotational torque between the turret and the riser assembly.

7. The turret mooring and riser hang-off arrangement according to claim 6, wherein the projection or the notch or cut-out is formed on a plate extending radially outward from the riser assembly.

8. The turret mooring and riser hang-off arrangement according to claim 1, wherein the cavity is arranged within a moonpool through a hull of the vessel in a forward part of the vessel.

9. The turret mooring and riser hang-off arrangement according to claim 1, wherein the cavity is arranged in a structure attached to a bow of the vessel, and that the upper surface of the vessel is an upper surface of a structure attached to an upper part of the bow of the vessel.

* * * * *